US005637025A

United States Patent [19]

Dahlgren

[11] Patent Number: 5,637,025

[45] Date of Patent: Jun. 10, 1997

[54] GATE AND HARBOR FOR WATER ACTIVITY TOY

[75] Inventor: Lennart Dahlgren, Askim, Sweden

[73] Assignee: Aquaplay AB, Sweden

[21] Appl. No.: 571,069

[22] Filed: Dec. 12, 1995

[51] Int. Cl.[6] ..... A63H 23/00

[52] U.S. Cl. ..... 446/153; 446/159; 446/160; 446/246

[58] Field of Search ..... 446/153, 159, 446/176, 199, 201, 267, 429, 236, 246, 89, 160; 472/13, 117, 128; 416/197 R; 366/325.7, 325.8, 325.94

[56] References Cited

U.S. PATENT DOCUMENTS

| | | | |
|---|---|---|---|
| 1,872,074 | 8/1932 | De Witt . | |
| 2,868,137 | 1/1959 | James | 446/159 |
| 4,905,987 | 3/1990 | Frenzi | 472/117 |
| 5,474,153 | 12/1995 | Iwamoto . | |

FOREIGN PATENT DOCUMENTS

| | | | |
|---|---|---|---|
| 1587277 | 4/1981 | United Kingdom | 446/153 |

*Primary Examiner*—Robert A. Hafer
*Assistant Examiner*—Jeffrey D. Carlson
*Attorney, Agent, or Firm*—Ostrolenk, Faber, Gerb & Soffen, LLP

[57] ABSTRACT

A water activity toy including a main channel portion for a stream of water, and the channel having a siding which distends one side of the channel. A gate or wall is pivotally supported on a pivot post in the main channel and is operable between an upstream-downstream orientation, which directs the main water flow through the main channel portion for floating a vessel through the main channel portion and an orientation transverse to the main channel portion which diverts the main water flow into the siding and floats the vessel into the siding. The gate is also operable to the upstream-downstream orientation with the vessel in the siding for retaining the vessel in the siding. The siding may be a harbor for the vessel. An impeller moves the water in a stream through the main channel.

7 Claims, 4 Drawing Sheets

GATE AND HARBOR FOR WATER ACTIVITY TOY

BACKGROUND OF THE INVENTION

The present invention relates to a water activity toy, particularly such a toy having a channel with a water stream flowing along the channel, and more particularly where the channel has a siding, which may serve as a harbor for a toy water vessel floating on the stream through the channel. The invention particularly relates to a gate or wall for establishing the border of a siding or harbor, for directing the water stream and the vessel into the siding or harbor and for temporarily retaining the vehicle in the siding or harbor.

A water activity toy may include a channel through which water passes in a stream, and often includes means for impelling the water to pass in the stream. For example, the toy may include an endless loop channel through which water passes. The water activity toy may have a floating vessel, like a toy boat, which rides on the stream.

At some point along the channel, it may be desired to detour the path of the floating water toy out of the main channel into a siding or harbor. A wall or gate may be positioned in the channel for separating the channel into the main channel and the siding or harbor. The invention is particularly directed to that gate in the channel and its operation.

SUMMARY OF THE INVENTION

It is the primary object of the present invention to provide means in the water channel of a water activity toy for separating the water stream in the channel into a main and/or siding flow perhaps at a harbor and to direct the stream and a vessel floating on the stream into the siding or harbor, as desired, and additionally to be able to retain the floating vessel in the siding or harbor while the stream continues to flow.

According to the invention, a gate or wall is disposed in the channel and is movable, preferably by swinging around a vertical pivot axis, between a first main flow orientation, e.g. an upstream-downstream orientation, where the gate directs the flow through the main channel, and a second detour orientation, e.g. transversely across the main channel, where the gate diverts the flow through the siding or harbor, and a vessel floating on the stream will travel with the stream into the siding or harbor.

Once the vessel enters the siding or harbor, the gate is then movable to another orientation, perhaps its first orientation, and in that position the gate may retain the vessel in the siding or harbor and may direct the flow both through the main channel and through the siding, but with less of the flow through the siding. When it is desired to release the vessel from the siding or harbor, the gate is swung to an orientation that opens the exit from the siding or harbor past the gate, perhaps the second orientation, and the stream of water passing through the siding or harbor moves the vessel out into the main stream.

Preferably the siding or harbor is defined in a distended side part of the channel, where the channel is temporarily widened.

Other objects and features of the present invention will become apparent from the following description of a preferred embodiment considered in conjunction with the accompanying drawings.

DETAILED DESCRIPTION OF A PREFERRED EMBODIMENT

Figure 1:
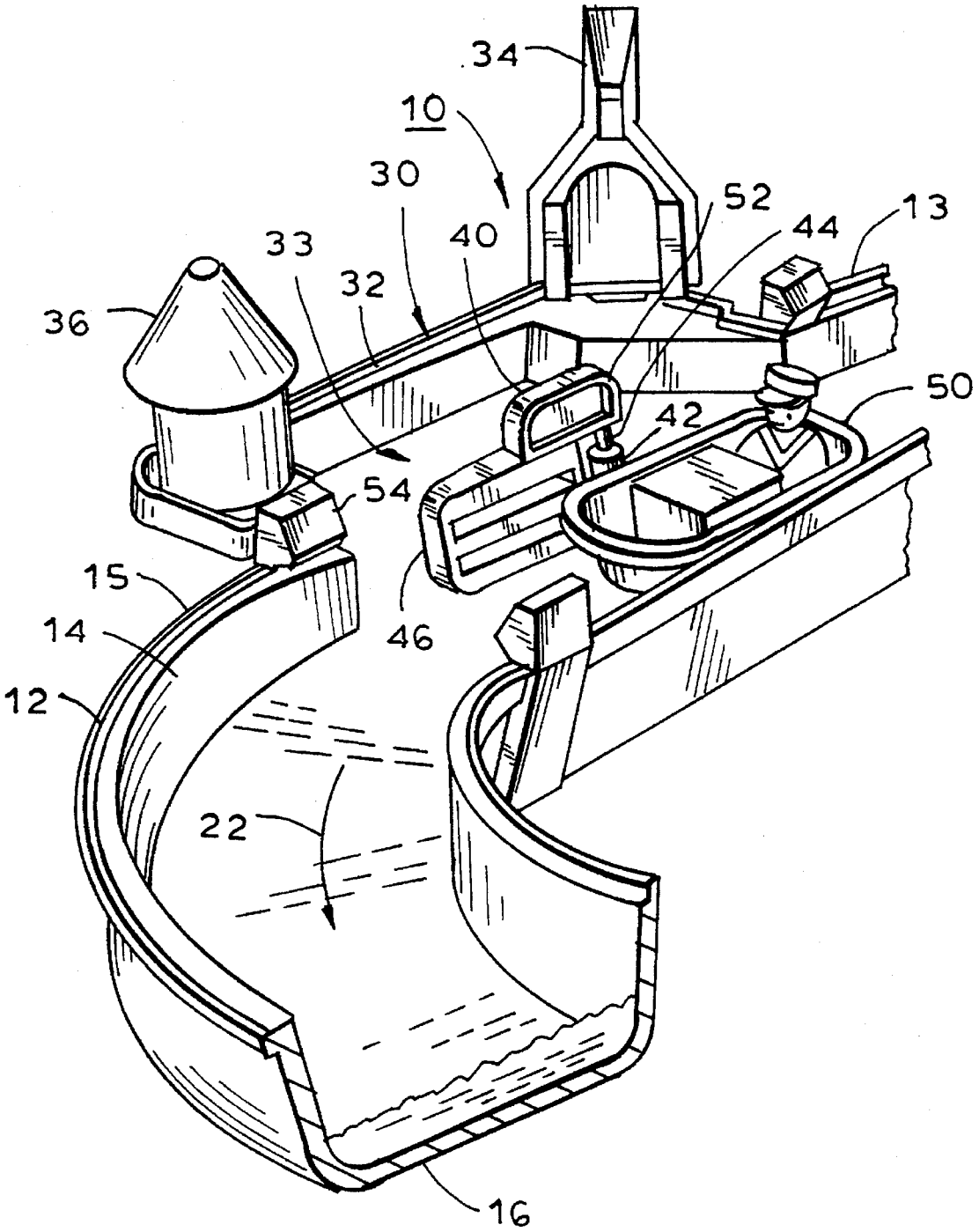
FIG. 1 shows a fragment of the channel of a water activity toy with a main channel and a siding or harbor, including a gate in a first operating orientation.
Figure 3:
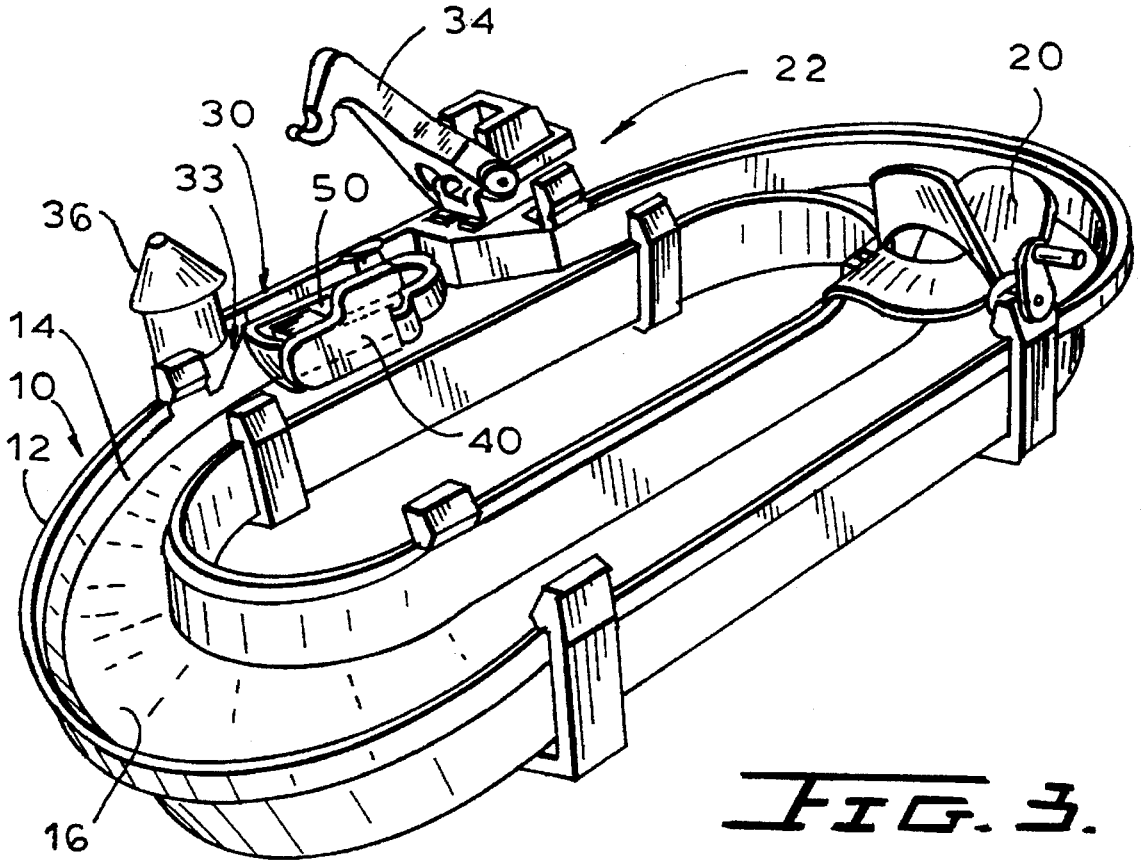
FIG. 3 shows the channel with the same gate in another orientation for retaining the vessel in the siding or harbor.

Referring to FIGS. 1 and 3, the water activity toy 10 includes an essentially endless loop, channel shaped water tank 12 which defines a channel 14 through which a stream 16 of water may flow.

The water tank is comprised of a simple molded plastic body that may be of one part or assembled of several parts. The channel may have any shape, circular, oval, racetrack shaped (as in FIG. 3), generally rectangular with rounded corners, or may be otherwise interestingly shaped. The water activity toy includes a water impeller of any sort, e.g. a bladed wheel 20 whose rotating blades swing through the channel 14 to move water downstream in the direction of arrow 22.

At one area along the length of the channel at one side of the channel, a siding or harbor 30 is defined. The side wall of the tank 12 is distended at 32 outward of the path of the upstream and downstream adjacent regions 13, 15 of the wall of the channel 14, thereby defining a siding 33 area next to the main channel 14. In this embodiment of the toy, the siding is a "harbor" for a floating vessel 50 where the vessel can be halted from its movement along with the water stream and stored in the siding. At the harbor, additional toys, not part of the invention, may be provided, e.g. the illustrated crane 34, observation tower 36, etc.

Figure 2:
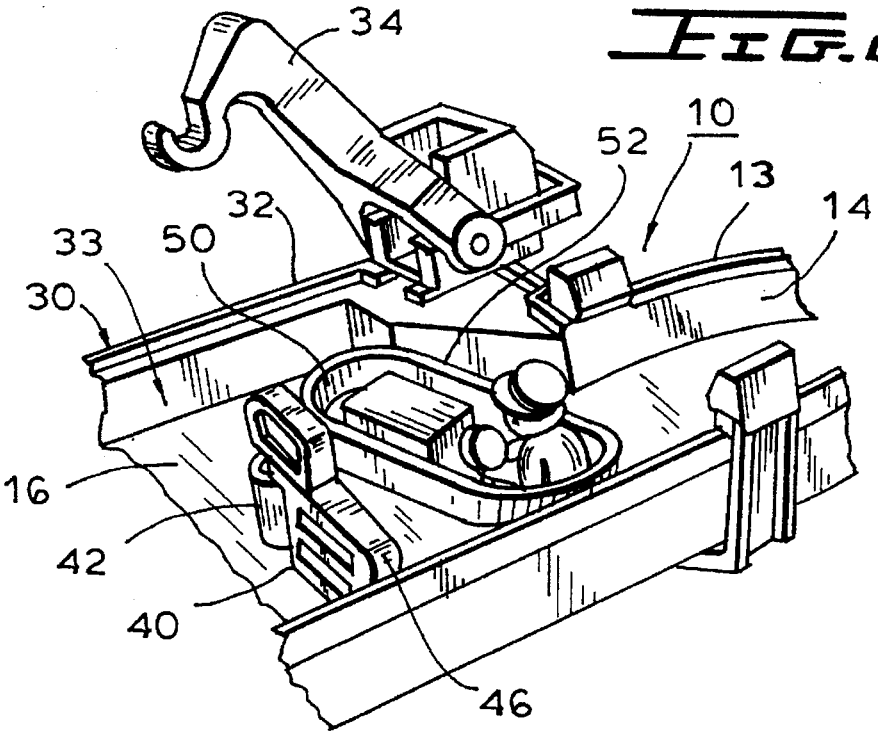
FIG. 2 is a view of part of the same fragment of the channel with the gate in a second orientation.
Figure 4:
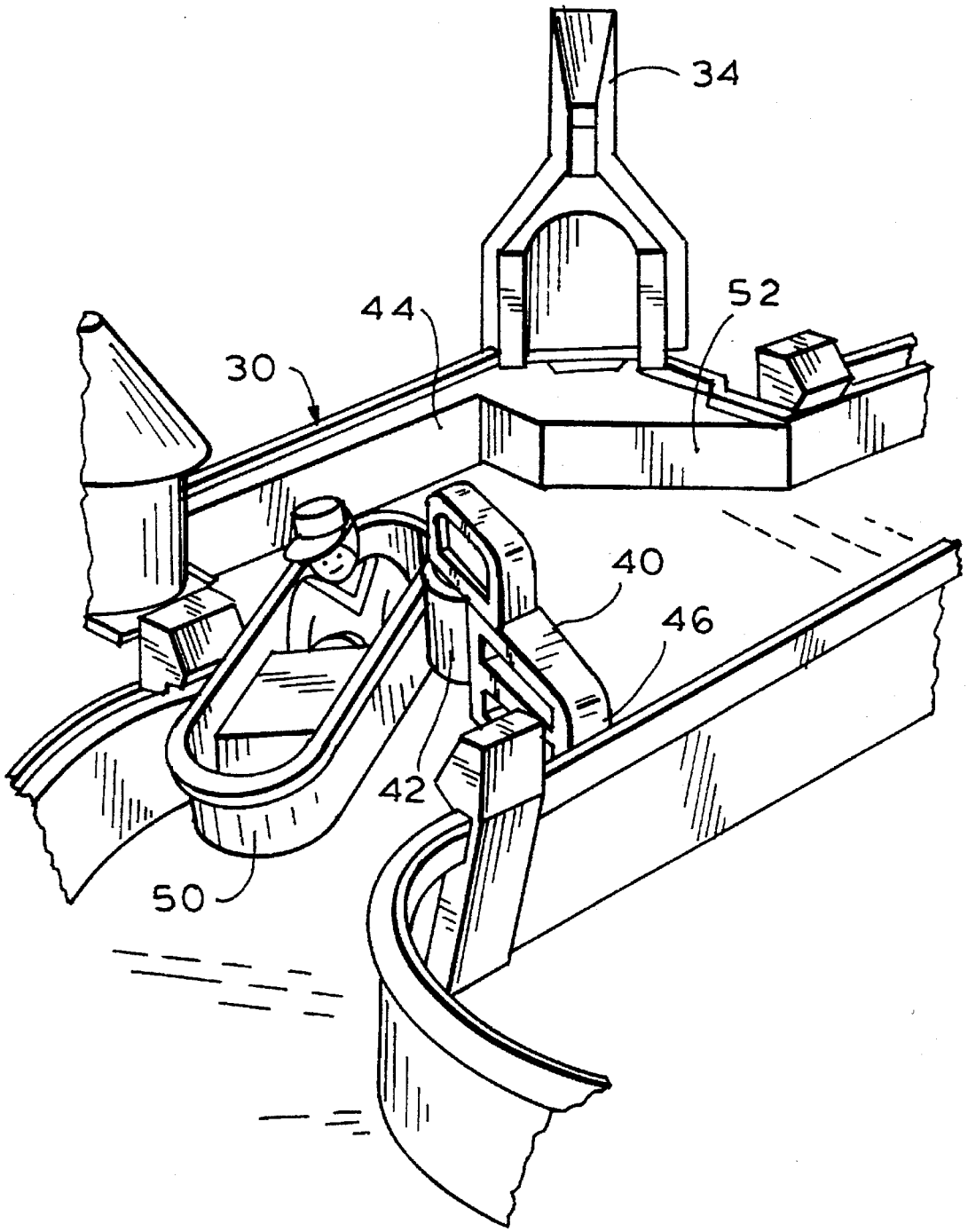
FIG. 4 shows the channel and gate in an orientation freeing the vessel to exit from the siding or harbor.
Figure 5:
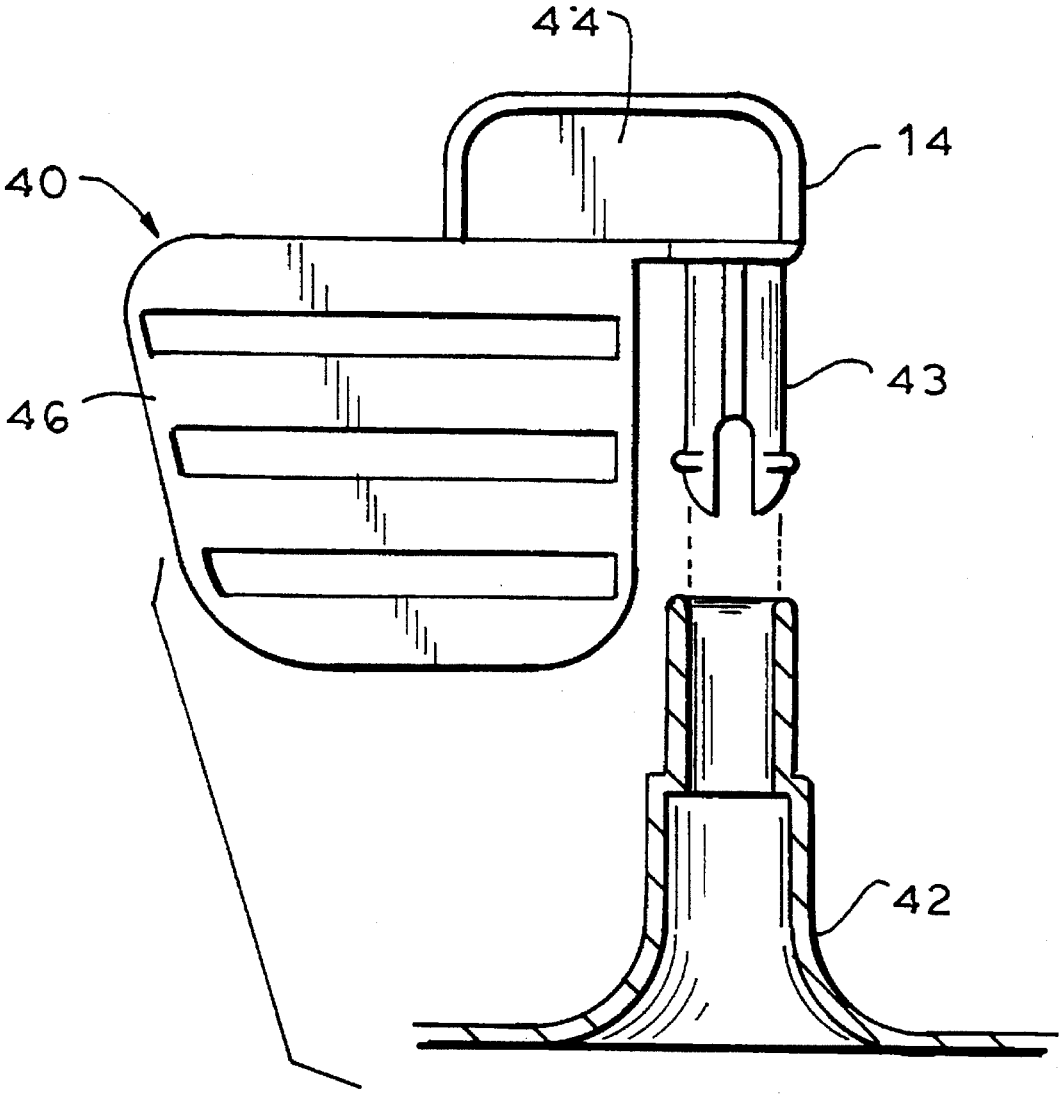
FIG. 5 is a view of the gate and of the post on which the gate is supported.

A wall or gate 40 controls the flow of water by directing it either through the main channel (FIGS. 1 and 3) or at least in part or totally diverting the main flow through the siding 33 (FIG. 2), which also correspondingly directs the floating vessel 50 either through the main channel 14 (FIG. 1) or into the siding 33 (FIG. 2). The gate 40 also can retain the vessel in the siding 33 (FIG. 3) and permit the vessel to exit the siding (FIG. 4).

The siding or harbor forming gate or wall 40 is disposed in the channel 14 and is supported at its leading or upstream end 44 on a hollow vertical pivot post 42 (FIGS. 1 and 4) which projects up from the floor of the tank 12 to receive, in the hollow of the post 42, the post 43 which depends from the end 44 of the gate. This enables the gate 40 to pivot around the post 42 between the first orientation shown in FIGS. 1 and 3, with the gate extending from its upstream end 44 to its downstream end 46 along the direction of the channel, and the second orientation shown in FIG. 2 that is across and perhaps transverse to the main channel, where a broad side of the gate blocks or at least inhibits flow through the main channel 14 and directs at least most of the flow through the siding 33. The post 42 is so positioned and the gate 40 is so positioned and of such length between its ends 44 and 46 and the outer wall 32 of the siding 33 is so distended that with the gate 40 in the first upstream to downstream orientation shown in FIGS. 1 and 3, the main channel 14 past the gate 40 is of a width sufficient to permit the passage of the floating vessel 50 through the main channel and also the siding 33 is wide enough to permit the vessel 50 to pass along or through the siding or be secured in the siding. As the vessel 50 floats in the stream of water and as the stream 16 is impelled to move around the channel 14 in the direction 22, the vessel 50 travels with the main flow. The gate 40 is of sufficient length and the flow is directed through the main channel such that the vessel 50 does not enter the siding or harbor.

The gate 40 can be pivoted from its upstream-downstream orientation in FIG. 1 to its transverse orientation shown in FIG. 2, with the free end 46 of the gate extending toward the side 35 of the main channel opposite the siding. The gate is of sufficient height in the channel as to either completely block or at least largely inhibit the flow through the main channel, and the flow is diverted by the gate into the siding 33. The gate 40 also blocks the vessel 50 from passing along the main channel. The water flow diverts the vessel 50 to flow into and pass through the siding. The pivot post 42 is far enough from both the upstream end 52 and the downstream end 54 of the distended side wall 32 of the siding 33 that with the gate pivoted to the flow diverting transverse position shown in FIG. 2, there is sufficient space for the vessel 50 to pass between the pivot post 42 and the upstream end 52 and enter the siding 33, to pass into and through the siding and, if the gate is not moved from its transverse orientation, to move out of the siding and back into the main channel.

After the vessel 50 has been floated into the siding 33 by the diverted stream, if it is desired to retain the vessel in the siding at the harbor, the gate 40 is again oriented upstream-downstream, as shown in FIG. 3, and this prevents exit of the vessel from the siding, because the open space between the downstream end 46 of the gate 40 and the downstream end 54 of the siding is too small to permit the vessel to exit. The force of the stream 16 is largely through the main channel 14 and little of the force is diverted into the siding 33, which is to the side of the main channel, so that the vessel may remain stationary in the siding with the wall in its upstream-downstream orientation, as shown in FIG. 3.

When it is eventually decided to permit the vessel to return to the main channel 14, the gate 40 is again pivoted to the transverse orientation as shown in FIG. 4. This diverts the full water stream through the siding, which pushes the vessel to exit from the siding 33 into the main channel and opens a large space between the pivot post 42 and the downstream end 54 of the siding so that the vessel 50 can exit the siding and reenter the main channel. Thereafter the person playing with the toy could decide in which orientation to place the gate 40 for the time when the vessel next passes the siding.

Although the present invention has been described in relation to a particular embodiment, many other variations and modifications and other uses will become apparent to those skilled in the art. It is preferred, therefore, that the present invention be limited not by the specific disclosure herein, but only by the appended claims.

What is claimed is:

1. A water activity toy with a siding arrangement for a water channel, said water activity toy comprising:

a water channel and a stream of water moving through the water channel;

the channel having and being defined between opposite first and second walls, the channel having a main channel portion and a siding off the main channel portion, an entrance into the siding from the main channel portion and an exit from the siding into the main channel portion, both the entrance and the exit communicating with the main channel portion;

a single gate disposed in the channel between the main channel portion and the siding, said gate being movable between a first orientation separating the main channel from the siding and a second orientation in which the gate extends across the main channel portion for diverting water from the stream of water through the siding while inhibiting flow through the main channel portion;

a pivot supporting the gate for pivoting between the first and second orientations, said pivot being disposed between said entrance and said exit, said gate having a pivot edge in the vicinity of said pivot and a free edge opposite said pivot edge, and with said gate being in the second orientation the free edge being in the vicinity of said first wall;

said pivot being disposed with respect to the entrance into and the exit from the siding such that with the gate in the second orientation, there is sufficient space between the pivot and the second wall defining the entrance into the siding such that a vessel floating in the stream of water may be diverted from the main channel portion past the pivot and through the entrance into the siding, and from the siding past the pivot and through the exit into the main channel portion wherein the pivot for the gate is so connected with said gate and is placed in the stream of water, and the gate is so placed and shaped and the main channel portion and the siding are so shaped that with the gate in the first orientation, the main channel portion is wide enough for a vessel floating in said stream of water to pass through the main channel portion past the gate and the space between the gate and the second wall defining a side of the siding is large enough for the vessel to be held in the siding between the gate and a portion of said second wall defining a side of the siding.

2. The toy of claim 1, further comprising means for said stream of impelling water to flow through the channel.

3. The toy of claim 2, wherein the first and second walls define an endless loop channel through which the water in the channel flows in an endless loop; said second wall surrounding said first wall and said siding being outboard of said main channel portion.

4. In combination, the toy of claim 1 and a floating vessel which floats in said stream of water, the vessel being of a length and width so that it can be floated forward through the main channel portion, can be diverted by the diverted flow of water through the entrance into the siding and can float through the siding and can float through the exit out of the siding and back into the channel.

5. A water activity toy with a siding arrangement for a water channel, said water activity toy comprising:

a water channel and a stream of water moving through the water channel;

the channel having and being defined between opposite first and second walls, the channel having a main channel portion and a siding off the main channel portion, an entrance into the siding from the main channel portion and an exit from the siding into the main channel portion, both the entrance and the exit communicating with the main channel portion;

a single gate disposed in the channel between the main channel portion and the siding, said gate being movable between a first orientation separating the main channel from the siding and a second orientation in which the gate extends across the main channel portion for diverting water from the stream of water through the siding while inhibiting flow through the main channel portion;

a pivot supporting the gate for pivoting between the first and second orientations, said pivot being disposed between said entrance and said exit, said gate having a pivot edge in the vicinity of said pivot and a free edge opposite said pivot edge, and with said gate being in the second orientation the free edge being in the vicinity of said first wall;

said pivot being disposed with respect to the entrance into and the exit from the siding such that with the gate in the second orientation, there is sufficient space between the pivot and the second wall defining the entrance into the siding such that a vessel floating in the stream of water may be diverted from the main channel portion past the pivot and through the entrance into the siding, and from the siding past the pivot and through the exit into the main channel portion; wherein in the first orientation, the gate extends along an upstream-downstream orientation; and in the second orientation, the gate extends transverse to the main channel;

with said gate in said first orientation said exit being closed against passage therethrough of vessels floating in said stream of water; and with said gate in said second orientation both said entrance and said exit being open for passage therethrough of vessels floating in said stream of water.

6. The toy of claim 5, wherein the main channel portion is defined by said first wall and the siding is defined by a distended portion of the second wall which distended portion is distended away from said first wall;

said gate being in the channel between the distended portion defining the siding and the first wall defining the main channel portion.

7. In combination, the toy of claim 5 and a floating vessel which floats in said stream of water, the vessel being of a length and width so that it can move forward through the main channel portion, can be diverted by the diverted flow of water through the entrance into the siding and can float through the siding and can move through the exit out of the siding and back into the channel.

* * * * *